United States Patent [19]

Sakurai

[11] Patent Number: 4,580,033

[45] Date of Patent: Apr. 1, 1986

[54] FIXING DEVICE

[75] Inventor: Masaaki Sakurai, Yokohama, Japan

[73] Assignee: Canon Kabushiki Kaisha, Tokyo, Japan

[21] Appl. No.: 643,694

[22] Filed: Aug. 24, 1984

[30] Foreign Application Priority Data

Sep. 1, 1983 [JP] Japan ..... 58-161271
Oct. 17, 1983 [JP] Japan ..... 58-192565

[51] Int. Cl.[4] ..... G03G 15/20

[52] U.S. Cl. ..... 219/216; 219/469; 355/3 FU

[58] Field of Search ..... 219/216, 469, 470, 471; 355/3 FU; 432/60, 228

[56] References Cited

U.S. PATENT DOCUMENTS 3,904,354 9/1975 Moser ..... 219/469
4,063,066 12/1977 Nagoshi ..... 219/216
4,200,389 4/1980 Matsui ..... 219/469

FOREIGN PATENT DOCUMENTS 2911526 9/1979 Fed. Rep. of Germany ... 355/3 FU
55-121466 9/1980 Japan ..... 355/3 FU
705411 12/1979 U.S.S.R. ..... 355/3 FU

*Primary Examiner*—C. L. Albritton
*Assistant Examiner*—Teresa J. Walberg
*Attorney, Agent, or Firm*—Fitzpatrick, Cella, Harper & Scinto

[57] ABSTRACT

A fixing device has first and second rotatable members for holding therebetween and conveying a recording material to fix an unfixed image on the recording material, and drive means for rotating the first and second rotatable members. The direction of projection of the convex portions of the surfaces of the first and second rotatable members is opposite to the direction of rotation of a roller.

17 Claims, 5 Drawing Figures

FIXING DEVICE

BACKGROUND OF THE INVENTION

1. Field of the Invention

This invention relates to a fixing device for fixing an unfixed image on a recording material by pressure or heat and pressure, and relates preferably to a fixing device having a pair of fixing rotatable members such as rollers or belts for fixing an unfixed toner image on a recording material.

Apparatuses to which the present invention is applicable include image forming apparatuses such as printers, facsimiles, copying apparatuses and printing machines, or various devices for fixing unfixed images on recording materials.

2. Description of the Prior Art

Fixing devices using a pair of rotatable members have heretofore often been used and above all, the roller fixation is most frequently used. This fixation is represented by heating-pressing fixation and pressure fixation.

The roller fixing devices may generally be divided into the following combinations (1) and (2): (1) a system using as a fixing roller for contacting a toner image including a rigid roller having a metal core coated with so-called Teflon such as PTFE or PFA and using as a pressure roller a roller coated with an elastic material such as silicon rubber, fluorine rubber, EPDM, Hydrin rubber or fluorosilicon rubber, and (2) a system using rollers coated with an elastic material as a fixing roller and a pressure roller.

Of the above-mentioned systems (1) and (2), where the roller coated with an elastic material mentioned under item (2) is used as the fixing roller, as compared with a case where the roller coated with Teflon is used as the fixing, roller, the device is excellent in fixing ability, image-producing properties and curling-preventing properties (and is particularly effective for automatic two side copying aparatuses) and therefore is very useful.

However, in the case of the system (2), if the surface of the fixing roller is rough, the roller is liable to be contaminated by toner during long-time use, and there has been a disadvantage that it is very difficult to remove the toner which has once adhered to the surface of the roller. Also, once the toner adheres to the surface of the roller, toner offset sharply increases because of the good affinity between such toner and the toner on copy paper, and this has caused jamming and other various troubles.

Also, a fixing roller equipped with a heater therein is usually weak in strength because the thickness of the elastic material must unavoidably be made small to promote heat conduction. When a cleaning member such as a felt, a web or a blade cleaning roller is caused to bear against the fixing roller, the elastic material may be damaged or other problems in respect of its durability may occur.

On the other hand, if the surface of the roller is made smooth to eliminate the above-noted inconveniences, the electrostatic attraction and vacuum attraction of copy paper to the roller increase and separability of the copy paper from the roller becomes more difficult.

Therefore, it becomes necessary to take a measure such as causing a pawl-like separating member to bear against the roller with a strong pressure, but this may give rise to a problem such as damaging the roller.

SUMMARY OF THE INVENTION

It is a primary of the present invention to solve the problem of offset and to provide a fixing device in which the life of the fixing rotatable member can be greatly improved.

It is another object of the present invention to provide a fixing device in which the contamination of the recording material by the contamination of the rotatable member is prevented and the separability of the recording material is high.

It is still another object of the present invention to provide a fixing device which is simple in construction and excellent in fixing ability and imagewise property and whose performance can be maintained for a long period of time.

It is yet still another object of the present invention to provide a fixing device in which occurrence of offset is prevented even when images are formed on both sides cf a recording material and which enables images firmly fixed to be obtained.

It is a further object of the present invention to provide a fixing device in which offset can be sharply decreased by a plurality of constructions concerned in fixation.

Other objects of the present invention will become apparent from the following detailed description taken in conjunction with the accompanying drawings.

DESCRIPTION OF THE PREFERRED EMBODIMENT

Figure 1:
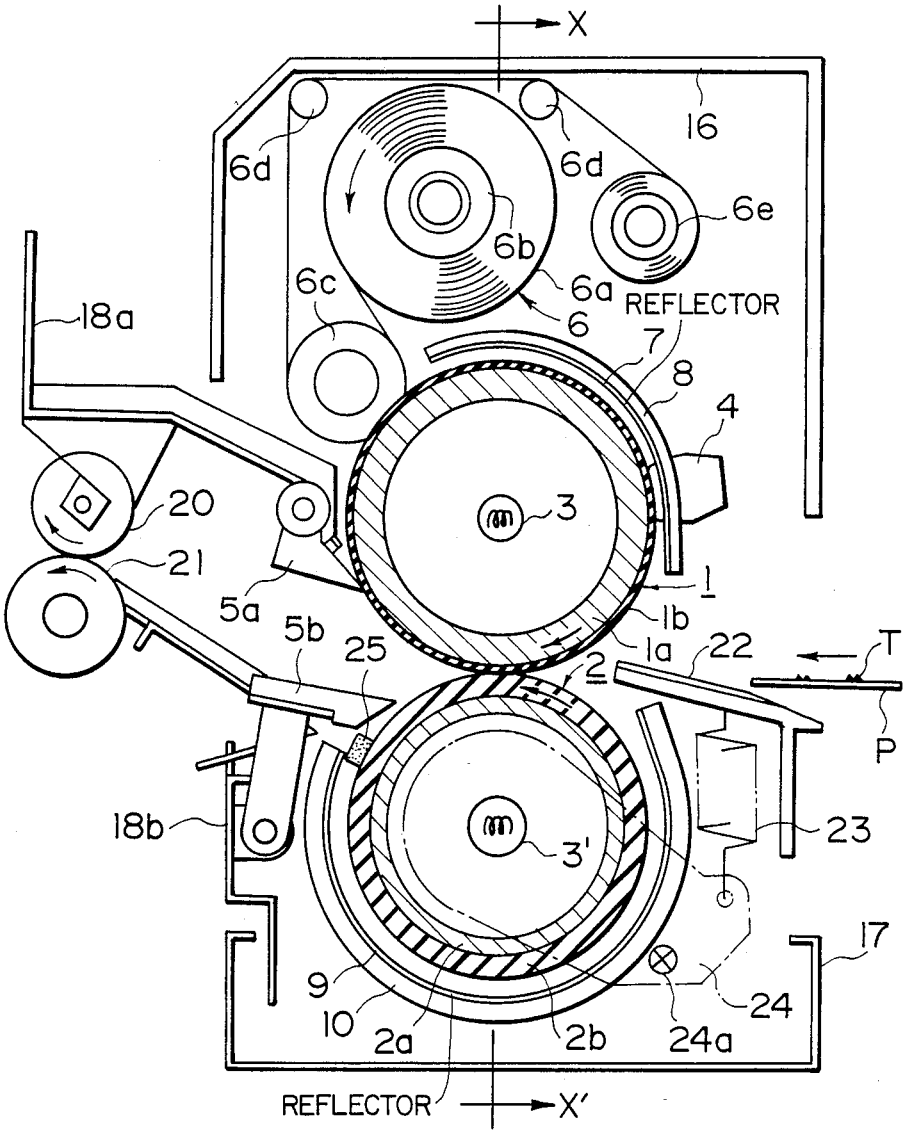
FIG. 1 is a side view of a fixing device to which the present invention is applied.

FIG. 1 shows an embodiment of the fixing device of the present invention. This embodiment is one in which a toner image T formed by the electrophotographic method is fixed on plain paper P by a heating-fixing device.

In FIG. 1, reference numeral 1 designates a heating roller, having therein a heater 3 such as a halogen heater, positioned on the side which is adjacent to the toner image T.

Reference numeral 2 denotes a pressure roller, having therein a low heating heater 3', adapted to be urged against the heating roller 1 to thereby heat and press the toner image against paper P and fix the image. The roller 1 is an elastic roller comprising a hollow roller core 1*a* made of a metal such as aluminum, stainless steel or copper and a relatively thin elastic layer 1*b* formed of a material such as silicon rubber, fluorine rubber or fluorosilicon rubber, and provided on the outer peripheral surface of the roller core 1*a*. The average surface roughness RZ of the peripheral surface of the elastic layer 1*b* is in the range of 1μ–10 μ.

The pressure roller 2 is rotatably supported by a bearing, not shown, and is adapted to be urged against the fixing roller 1 by conventional pressing means during at least the fixation, and it comprises a hollow metallic roller core 2*a* and a relatively thick elastic layer 2*b* formed of a material such as silicon rubber, fluorine rubber, fluorosilicon rubber, EPDM or hydrin rubber, and provided on the outer peripheral surface of the roller core 2*a*. The average surface roughness RZ of the peripheral surface of the elastic layer 2*b* is set to the range of 6μ– 25μ and moreover, this roughness is rougher than the average surface roughness of the elastic layer 1*b* of the fixing roller 1.

In the present preferred embodiment, the average surface roughness of the heating roller 1 is about 2μ and the average surface roughness of the pressure roller is about 7μ.

The thermal offset preventing construction of the present embodiment will hereinafter be described. To obtain a uniform surface temperature by preventing the heat of the fixing roller 1 and the pressure roller 2 from escaping by heat conduction from a portion which supports the pressure roller 2, etc., a thermally insulating material such as plastic is used for a gear transmitting the drive force of a motor or the bearings of the roller to thereby bring the fixing roller 1 and the pressure roller 2 into their thermally floated state. However, when a number of paper sheets are continuously passed between the fixing roller 1 and the pressure roller 2, the heat in the central portions of these rollers is taken by the paper sheets and the temperature of the central portions of the rollers becomes lower, but at the end portions of the rollers, the transfer of heat to the paper sheets passed between the rollers is small as compared with the central portions of the rollers. Accordingly, the temperature drop of the end portions of the rollers becomes smaller than the temperature drop of the central portions of the rollers. At this time, the heat in the end portions of the rollers is conducted toward the central portions of the rollers and the heat of the entire surfaces of the rollers becomes uniform, but after all, unsatisfactory fixation in the central portions will result and this will lead to the inadequacy of image fixation. Accordingly, to eliminate this influence, the distribution of heat generation of the heater 3 provided in the fixing roller 1 is such that the amount of generated heat in the central portion of the fixing roller 1 is about double that in the end portions of the fixing roller 1. Thus, normally as well as during continuous passage of paper sheets, the surface of the roller exhibits a good uhiform temperature suited for fixation. A thermosensitive element 4 such as a thermistor or a thermocouple is disposed in contact with the outer peripheral surface of the fixing roller 1, and the detection signal thereof is directed to conventional control means, not shown, to thereby maintain the temperature of the outer peripheral surface of the fixing roller 1 at a toner image melting temperature (by controlling the output of the heater 3 or the voltage applied thereto).

Reference numeral 6 designates an offset preventing liquid application member which serves also as a cleaning member for removing foreign substances such as offset toner and paper powder adhering to the surface of the fixing roller 1 from the surface of said roller, and it comprises a heat-resistant web 6*a* such as Normex or Himeron impregnated with offset preventing liquid such as dimethyl silicon oil, methyl phenyl silicon oil, fluorosilicon oil or amino-denatured silicon oil.

The cleaning web 6*a* bears against the heating roller with the aid of a push roller 6*c* having elasticity. Also, this web 6*a* is moved from a supply roller 6*b* by a take-up roller 6*e* so as to change its bearing position slightly and thus, the new surface portion of the cleaning web 6*a* always bears against the fixing roller 1. This web 6*a* moves on a roller 6*d* disposed above the push roller 6*c* and is reversed to the supply roller 6*b* side and taken up by the take-up roller 6*e* while remaining reversed.

Reference numeral 7 designates a curved reflecting plate having a heat-reflecting property and provided in proximity to the outer periphery of the fixing roller 1 along the full length of the fixing roller 1. The reflecting plate 7 has a width sufficient to cover the space between the push roller 6*c* urged against the peripheral surface of the fixing roller 1 and the inlet opening portion for paper P. Reference numeral 8 denotes a cover thick enough to prevent heat radiation and provided in intimate contact with the entire convex surface of the reflecting Plate 7 to prevent any wasteful heat radiation from the reflecting plate 7. Reference numeral 16 designates a casing member above the fixing device. The casing member 16 surrounds the cleaning member 6, the reflecting plate 7, the cover 8 and the thermosensitive element 4. The temperature detecting portion of the thermosensitive element 4 is more adjacent to the roller 1 than the reflecting plate 7.

On the other hand, on the pressure roller 2 side, a reflecting plate 9 similar to the reflecting plate 7 and a cover 10 similar to the cover 8 are provided so as to cover most of the peripheral surface of the pressure roller 2.

By the adiabatic merbers such as the reflecting plates 7, 9 and the covers 8, 10 being thus provided, the heat wastefully consumed from the fixing roller and the pressure roller can be decreased and the temperature measuring property of the thermosensitive element 4 can be stabilized. Accordingly, the offset resulting from temperature irregularity can be greatly prevented. Also, the temperature of the fixing roller 1 relative to the set temperature can be stabilized and the power consumption can be reduced.

Reference numeral 22 designates a guide plate for guiding paper P toward the fixing roller 1. The guide plate 22 is provided in proximity to the fixing roller 1 so as to be positioned between one end of the reflecting plate 7 and one end of the reflecting plate 9. Reference numeral 24 denotes a support plate having a center of rotation 24*a* and supporting the pressure roller 2. The pressure roller 2 is urged against the fixing roller 1 by a pressure spring 23.

Now, the plain paper P having the unfixed toner image T thereon is held between and conveyed by the fixing and pressure rollers 1 and 2 and the toner image T is fixed by the heat resulting from the surface temperature of the rollers 1 and 2, whereafter the plain paper P is discharged out of the device while being held between and by paper discharge rollers 20 and 21. On the discharge port side of the fixing roller, a plurality of separating pawls 5*a* are provided along the axial direction of the roller and in contact with the surface of the roller 1 to positively separate the plain paper P from the fixing roller.

Also, on the discharge port side of the pressure roller 2, a separating pawl 5*b* is provided in contact with the surface of the roller 2.

The separating pawls 5a are held by a support plate 18a spaced apart from the casing member 16, and the separating pawl 5b also is held by a support plate 18b spaced apart from a casing member 17 below the fixing device. The casing member 17 is provided in spaced relationship to the reflecting plate 9 and cover 10 of the pressure roller so as to cover these.

Reference numeral 25 designates a cleaning member urged against the pressure roller 2 by unshown means. The cleaning member 25 is formed of felt or like material and is for removing the toner offset to the pressure roller.

The reflecting plates 7 and 9 may preferably be formed of a metal having a lustrous surface, such as an aluminum or copper plate having a polished surface or an iron plate subjected to the surface treatment such as Cr plating. The shape of the reflecting plates 7 and 9 may preferably be one having such a curvature that these plates are concentric with the peripheral surfaces of the rollers, and the thicknesses thereof may preferably be relatively small.

The covers 8 and 10 may preferably be formed of one or more of glass wool, rock wool, ceramic fiber and foamed material such as phenol foam or epoxy foam.

Figure 2:
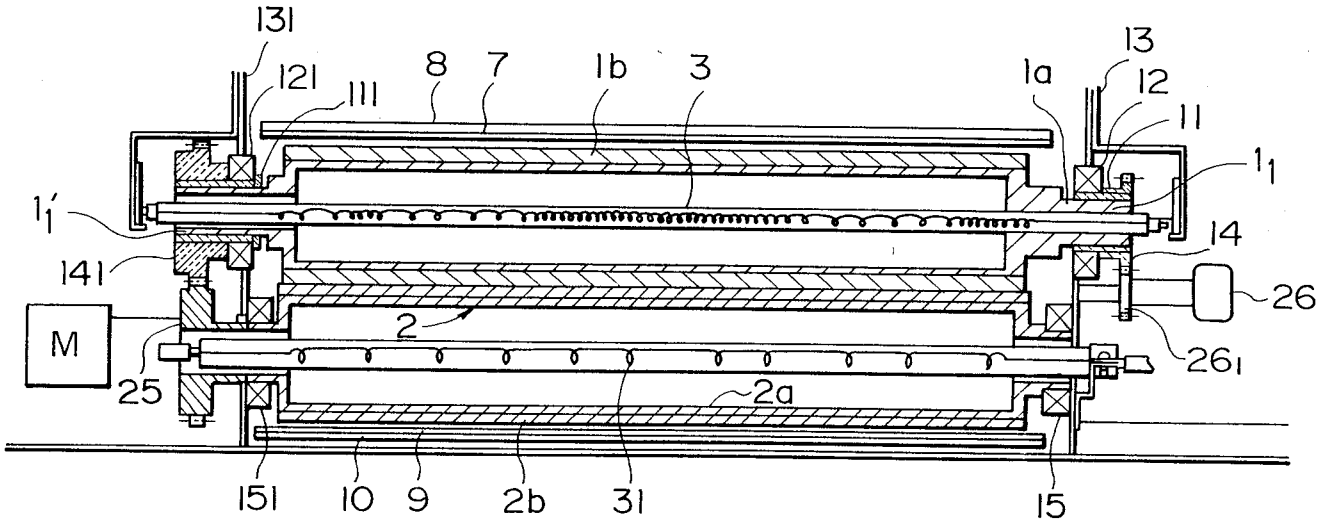
FIG. 2 is a cross-sectional view taken along line X–X' of FIG. 1.

The construction of the end portion of the heating roller 1 will now be described in detail by reference to FIG. 2 which is a cross-sectional view of the fixing device taken along line X—X' of FIG. 1.

Reference numerals 11 and 111 designate heat resisting sleeves of adiabatic resin fitted to the opposite ends of the rotary shaft $1_1$, of the heating roller 1. The sleeves 11 and 111 are rotatably in contact with bearings 12 and 121 mounted on the frame members 13 and 131, respectively, of the fixing device. Reference numerals 14 and 141 denote heat resisting gears fitted to the rotary shafts $1_1$ and $1_1'$, respectively, of the heating roller 1. The drive force from a drive source M is transmitted to these gears 14 and 141. The heat resisting gear 141 is in mesh engagement with the drive transmitting gear 25 of the pressure roller and receives the drive force and rotates with the heating roller 1. Accordingly, the rollers are not rotatively driven by each other but are rotated directly in response to the drive force. The gear $26_1$ of a manually operated knob 26 is in mesh engagement with the heat resisting gear 14 and a manual drive force is transmitted thereto.

Since the heat resisting gears 14 and 141 are formed of a heat-intercepting adiabatic material, heat is not dissipated from the heating roller 1 to other drive transmitting members such as these gears 14 and 141. The heat-retaining property of the heating roller 1 is improved by these gears.

Further, the heat resisting sleeves 11 and 111 also are formed of a heat-intercepting adiabatic material and prevent the heat loss resulting from the transfer of heat from the end portions of the heating roller 1 to the bearings 12, 121 and the frame members 13, 131. Accordingly, the heat loss from the end portions of the heating roller 1 can be decreased by the heat resisting gears 14 and 141, as compared with the prior art, and the addition of the heat resisting sleeves 11 and 111 can greatly reduce or substantially eliminate such heat loss.

Generally, it is often the case that other numerous drive transmitting members are operatively associated with the heat resisting gears 14 and 141. Consequently, most of the heat loss has heretofore occurred in such a driving system. In contrast, the above-described embodiment can reduce or eliminate the heat loss to the driving system and therefore, the heat efficiency can be highly enhanced and the power consumption can be reduced. Also, in the above-described embodiment, the heat resisting sleeves 11 and 111 are employed in addition to the heat resisting gears 14 and 141 and therefore, the heat loss from the end portions of the roller to the frame members 13 and 131 can be prevented and the heat efficiency can be further enhanced. In the above-described embodiment, the heat resisting gears are provided at the opposite ends of the heating roller 1, but it will be effective if there is an adiabatic region between the side which receives the drive force of the member for transmitting the drive force and at least the roller 1 and the roller 2. The heat resisting sleeves may preferably be formed of a heat-intercepting material such as polyimide, polyamide imide, polyamide, PPS(polyphenylene sulfide), PBT (polybutylene terephthalate) resin or phenol resin or a mixture of these materials. Also, the gears 14 and 141 may preferably be formed of a heat resisting material good in heat-intercepting property, such as polyimide, polyamide imide, PPS, denatured phenol, or a material composed of tetrafluoroethylene having a reinforcing filler added thereto.

As described above, the heating roller 1 becomes thermally isolated from the machine body and the frame members 13, 131 by the heat resisting sleeves 11, 111 and the heat resisting gears 14, 141, and the heat loss through these members is very small. Accordingly, the possibility of occurrence of the offset resulting from temperature change can be reduced.

In the above-described construction, the heat efficiency is very high and in single copying, uniformly good fixation is obtained, but if continuous copying is effected, the image-fixation at the central portion of copy paper becomes inadequate as compared with the fixation of the marginal portion of the copy paper. This effect becomes more remarkable as the number of paper sheets is increased.

The following two reasons may be mentioned for this:

Reason 1: The temperature of the central portion of the roller is lowered by the heat being taken by copy paper. On the other hand, at the end portions of the roller, transfer of heat to the copy paper is low as compared with that at the central portion of the roller and therefore, the temperature drop at the end portions of the roller is smaller than the temperature drop at the central portion of the roller. That is, the surface temperature of the roller is higher at the end portions of the roller than at the central portion of the roller.

Reason 2: By the reason 1 above, the amount of heat which the pressure roller receives from the fixing roller is greater at the end portions than at the central portion and therefore, the temperature of the pressure roller also is higher at the end portions than at the central portion. Because of this, the pressure roller is thermally expanded to the form of an inverted crown and the pressure contact force of the two rollers also is higher in the end portions thereof.

Figure 3:
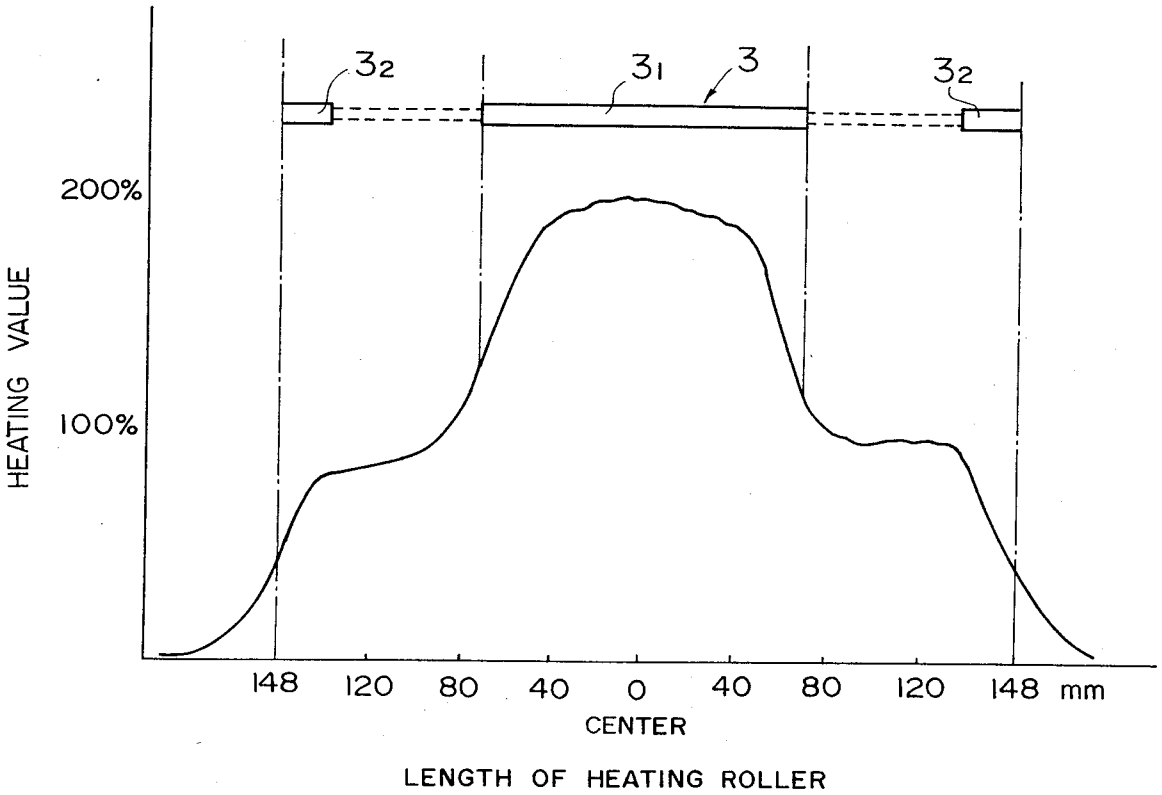
FIG. 3 a graph showing the distribution of the heating value of the heater 3 of FIG. 1.

Consequently, as regards the distribution of generated heat of the heater in the fixing roller, it is preferable to use a roller which is greater in amount of generated heat in the central portion than in the end portions. Also, it is preferable that the length of heat generation of the heater be equal to or shorter than the width of the paper of maximum size. For example, the use of the heater having characteristics shown in FIG. 3 would ensure uniform good fixation to be obtained in both of single copying and continuous copying.

Also, the use of a heater in which the length of heat generation is shorter by the order of 10–60 mm than the width of the paper of maximum size has led to a good result.

In the fixing device of the above-described construction, a roller having an outer diameter of 60 mm and an aluminum mandrel of thickness 6.5 mm and having an inverted crown shape (the diameter of the central portion is smaller by 150μ than that of the end portions) having a heat-vulcanized silicon rubber coating (TSE 220-6μ produced by Toshiba Co., Ltd.) as the surface coating layer has been used as the fixing roller 1, and a roller comprising an iron mandrel having an outer diameter of 60 mm or 50 mm and a heat-vulcanized silicon rubber coating (KE7427 produced by Shinetsu Kagaku Co., Ltd.) or rubber hardness 40° (JISA) and thickness 5 mm provided on the iron mandrel has been used as the pressure roller 2.

Also, the fixing roller and the pressure roller have been used with their polished surfaces installed so that the direction of projection of the convex portions of the rough surfaces thereof is in reverse direction (hereinafter referred to as the forward orientation) relative to the directions of the rotation of the rollers.

Figure 4A:
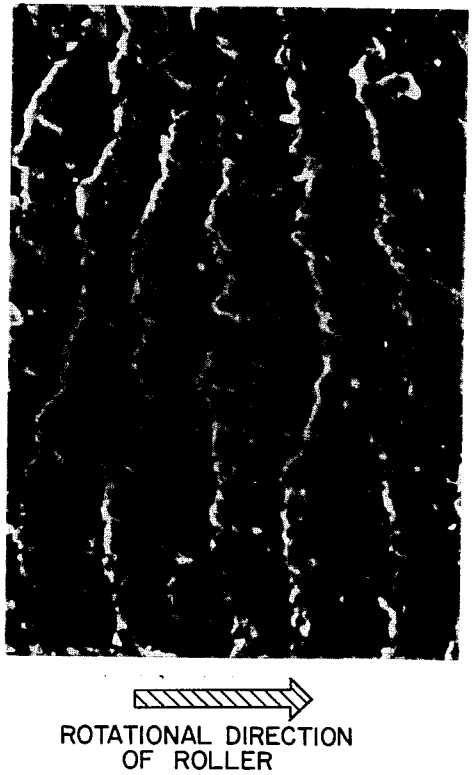
FIG. 4A is a diagrammatic illustration including an enlarged photograph of the surface of a fixing roller with respect to the fixing rotational direction thereof.
Figure 4B:
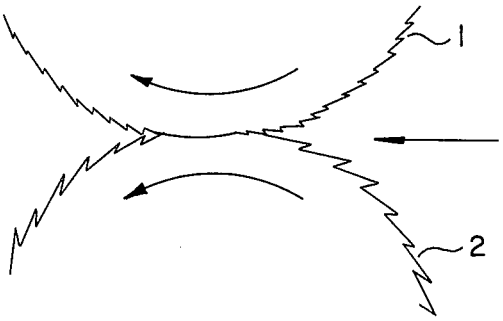
FIG. 4B is an enlarged schematic illustration of the direction of grains of the surface of the fixing roller.

The term "forward orientation" of the direction of projection will hereinafter be explained. FIG. 4A shows a typical example of the surface photograph of the fixing roller (using SEM, the magnification being 100 times, and the average surface roughness $R_z$ in this case being $R_z=8\mu$). When a roller of elastic material such as rubber is polished, there are generally created polished grains as shown in FIG. 4A. (It is possible to substantially eliminate these polished grains by finish polishing such as feather polishing or the like, but this requires much labor and cost.)

The use of the forward orientation so-called in the present invention, is to install the roller in a direction in which the polished grains lie down at the nip relative to the rotation of the roller, and in FIG. 4A, the direction of arrow is the rotational direction of the roller. FIG. 4A schematically shows the polished grains of the convex portions of the rough surface. (The directions of arrows are the rotational directions of the rollers.)

A halogen heater of 650 W is used as the heater 3 in the fixing roller, the surface temperature of the roller is detected by the thermistor 4, and the heater is ON-OFF-controlled by a control circuit, not shown, to thereby maintain the surface temperature of the fixing roller at 170° C. at all times.

Also, the copy paper processing speed of the fixing device is 405 mm/sec., 60 sheets/min. A4 size.

As the separating pawls 5, use has been made of pawls comprising denatured Teflon coat sintered on polyamide imide in the form of a sharp edge having a width of contact of 2 mm with the fixing roller and having a fore end edge of 0.1R. Also, the position of the pivotal fulcrum has been made free to eat in (the words "free to eat in" meaning that the fulcrum is on the opposite side to the roller with respect to the tangential line at the point of contact between the fore end of the separating pawl and the surface of the roller). The web 6 is impregnated with dimetyl silicon oil (KF96H produced by Shinetsu Kagaku Co., Ltd, and having a viscosity of 10,000 CS at 25° C.), and the web is gradually moved during copying, whereby fixation is effected while silicon oil of $1\times10^{-4}$ g per sheet of A4 size is applied to the surface of the fixing roller.

(Embodiment 1)

A roller having an average surface roughness Rz of μ used as the fixing roller, and a roller having an average surface roughness Rz of 18μ was used as the pressure roller. The direction in which these rollers were installed were the directions shown in FIGS. 4A and B. The pressure of contact of the separating pawls with the fixing roller was 10 g. 300,000 sheets with toner images borne on 15% of the total area of A4 size paper were continuously supplied, but there occurred no jam. The manner of separation was visually confirmed, the copy paper after fixation was separated substantially without resorting to the separating pawls. It was also observed that the slight amount of offset toner to the fixing roller shifted well toward the pressure roller due to the difference in surface roughness when the fixing roller urged against the pressure roller was rotated during the interval of copy paper supply. When a cleaning felt is caused to bear against the pressure roller with a great pressure, the cleaning felt can remove toner that has shifted to the pressure roller. Also, the pressure roller has a relatively great rubber thickness and sufficient rubber elasticity and therefore is not liable to be damaged and permits the cleaning member to bear thereagainst with a great pressure.

The pressure roller, after the supply of 300,000 sheets of paper, was generally slightly contaminated by toner, but the surface of the fixing roller was not stained at all and further supply of paper sheets was possible.

If the rollers 1 and 2 are of a construction in which both of them are in forward orientation with respect to the rotational directions thereof, the offset preventing effect is great and no great offset occurred up to the order of 200,000 sheets of paper. In the embodiment having the above-described construction (FIGS. 1 to 3), the effect becomes high due to the interaction, but a preferable embodiment will also be provided by arbitrarily selecting and constructing the rollers.

(Comparative Example 1)

Supply of paper sheets was effected under the same conditions as in Embodiment 1 with the exception that the direction in which the pair of rollers were installed was reversed.

Slight offset to the fixing roller occurred each time and most of the offset toner shifted toward the pressure roller due to the difference in surface roughness between the fixing roller and the pressure roller when these rollers were urged against each other and rotated during the interval of supply of copy sheets, but part of the offset toner clogged the polished grains of the fixing roller and remained adhering (fused) on the surface of the fixing roller. It is difficult to wipe off the adhering toner by the cleaning web 6, and the fixing roller became locally contaminated. When continuous supply of paper sheets was further effected, said contamination increased and when about 50,000 sheets of paper were supplied, jamming of copy paper occurred frequently due to said contamination. That is, when the rollers were installed in the reverse orientation, toner offset was liable to occur in the interior of polished grains and the toner which has entered the interior of the polished grains could not be removed by the cleaning member (the web 6) but was accmulated therein. By the toner which entered the interior of the polished grains, the offset was further expected to cause jamming.

This was slightly alleviated by increasing the amount of oil applied, but the effect was still incomplete even when tenfold oil was applied.

As described above, in a case where the roller is formed of an elastic material such as rubber, a great difference was seen in the life of the roller depending on whether the polished grains of the roller were in forward orientation or in reverse orientation. Further, the forward orientation may be used for the improved fixing device and the surface roughness of the rollers may be of the values shown below.

That is, the average surface roughness $R_z$ of the fixing roller was 1–12$\mu$ and the average surface roughness $R_z$ of the pressure roller was 6–25$\mu$, and a better result was obtained where the surface of the pressure roller was rougher than the surface of the fixing roller.

If the average surface roughness of the fixing roller is greater than 12$\mu$ (this is of about the same degree as the average particle diameter of the toner), even if the roller is installed in forward orientation, the surface of the roller is liable to be stained by offset toner and it is difficult to remove the stain by the cleaning member. Therefore, it becomes necessary to increase the pressure force of the cleaning member against the fixing roller or increase the width of contact of the cleaning member with the roller. As a result, such an inconvenience as increased torque occurs, and this leads to the necessity of using a drive motor of high power and accordingly to bulkiness and increased cost of the device. Also, even if said countermeasure is taken the toner on the surface of the roller cannot sometimes be removed and thus, jamming or the like occurred in some cases.

Also, providing a smooth surface in which $R_z$ is 1$\mu$ or less requires a high cost of manufacture and is not economical. Moreover, electrostatic attraction and vacuum (reduced pressure) attraction of copy paper to the roller is liable to occur and copy paper is liable to twine around the roller.

As previously described, in some cases, the toner which has been offset little by little to the surface of the fixing roller cannot be removed by the web 6 bearing against the fixing roller with a light pressure.

Once toner offset occurs to the fixing roller, the toner offset is sharply increased by the affinity between toner particles. Thus, in the present invention, it has been confirmed that when the surface roughness of the pressure roller is made greater than that of the , fixing roller which is adjacent to the toner image, the offset toner shifts to the pressure roller due to the difference in surface roughness. That is, by the construction in which the pressure roller is of a rougher surface than the fixing roller, the offset toner on the fixing roller can be removed and the attendant cause of offset can be eliminated.

Also, the pressure roller is relatively great in thickness of the elastic material and great in strength and therefore, it permits a cleaning member such as a cleaning felt, a cleaning web, a metal blade or a rubber blade to bear thereagainst with a strong pressure and thus, the toner on the pressure roller can be removed.

Also, where both rollers are installed in forward orientation, it is possible to cause the toner to adhere little by little to the back side of copy paper each time (to such a degree that the adhering toner does not become a stain on the paper) and in this case, it is not necessary to cause the cleaning member to bear against the pressure roller.

The present invention, except for thermal elements, is also effective for a pressure fixing device using a pressure fixing system, and the construction of the upper and lower rollers in the above-mentioned range of numerical value in which the construction in the direction of grains of the roller surface is eliminated is also effective for offset prevention and separation.

The present invention is excellent in image-producing properties, enables high-speed fixation to be accomplished and is high in offset preventing effect even in the case of complicated recording (two-side recording or multiplex recording).

Any of the above-described features and constructions can sharply decrease the offset toner which is liable to be created on and adhere to the rotatable member on that side which contacts the unfixed image, and the combined offset preventing effect with other constructions is obtained by the respective effects, whereby the contamination of the rotatable member on the image side can be prevented for a long period and the life thereof can be lengthened.

What I claim is:

1. A fixing device having:

first and second rotatable members for holding therebetween and conveying a recording material to fix an unfixed image on said recording material; and drive means for rotating said first and second rotatable members each in a direction of rotation;

said first and second rotatable members each having a surface having convex portions projecting therefrom in a direction of projection, the direction of projection of said convex portions of said surface of said first rotatable member being opposite to the direction of rotation of said first rotatable member, and the direction of projection of said convex portions of said surface of said second rotatable member being opposite to the direction of rotation of said second rotatable member.

2. A fixing device according to claim 1, wherein said surface of each of said first and second rotatable members has an average surface roughness $R_z$ which is at least 1$\mu$, and wherein each of said first and second rotatable members comprises a surface layer formed of an elastic material.

3. A fixing device according to claim 2, wherein said elastic material is rubber.

4. A fixing device according to claim 1, wherein said drive means has means for transmitting a drive force directly to said first and second rotatable members.

5. A fixing device for fixing an unfixed image on a recording material, having:

first and second rollers, each having a peripheral surface having an average surface roughness and convex portions projecting in a direction of projection, said first and second rollers being mounted for rotation in a direction of rotation for holding therebetween and conveying the recording material;

means for urging said first and second rollers against each other to press the recording material between said first and second rollers;

said first roller being an elastic roller and being positioned to contact that side on which said unfixed image on said recording material is to be fixed and to contact said unfixed image; and said second roller being an elastic roller and being positioned to contact the side opposite to that side on which said unfixed image on said recording material is to be fixed and to contact said recording material;

the average roughness of the peripheral surface of said first roller being greater than the average roughness of the peripheral surface of said second roller, the direction of projection of said convex portions of said peripheral surface of said first roller being opposite to the direction of rotation of said first roller, and the direction of projection of said convex portions of said peripheral surface of said second roller being opposite to the direction of rotation of said second roller.

6. A fixing device according to claim 5, wherein the average surface roughness $R_z$ of said first roller is $1\mu$ to $20\mu$ and the average surface roughness $R_z$ of said second roller is $6\mu$–$25\mu$.

7. A fixing device according to claim 6, wherein each of said first and second rollers has a rubber elastic surface.

8. A fixing device according to claim 5, further having drive means for imparting a drive force to said first and second rollers.

9. A fixing device according to claim 5, wherein said first roller has heating means therein, wherein adiabatic means are provided at opposite ends thereof to suppress heat loss from said opposite ends, and wherein a heat-reflecting member is provided on the surface of said first roller.

10. A fixing device according to claim 9, wherein said first roller has end portions and a central portion, and wherein said heating means has a heating member the amount of heat generated thereby being greater in said central portion of said first roller than in said end portions of said first roller.

11. A fixing device according to claim 9, wherein said heating means has a heating member which exhibits a substantially uniform distribution of heat generation substantially over the full length of said first roller.

12. A fixing device having:

first and second rotatable members for holding therebetween and conveying a recording material to fix an unfixed image on said recording material; and drive means for rotating said first and second rotatable members each in a direction of rotation;

said first and second rotatable members each have a surface having convex portions projecting therefrom in a direction of projection, the direction of projection of said convex portions of said surface of said first rotatable member being opposite to the direction of rotation of said first rotable member and the direction of projection of said convex portions of said surface of said second rotatable member being opposite to the direction of rotation of said second rotatable member;

heating means provided within said first rotatable means;

transmitting means for transmitting driving force from said driving means to said first rotatable member; said transmitting means including a heat-insulating gear connected to said first rotatable member; and supporting means for rotatably supporting and heat-insulating said first rotatable member.

13. A fixing device according to claim 12, wherein said first rotatable member is manually rotatable, and further comprising a heat-insulative driving force transmitting member for transmitting manual force to said first rotatable member.

14. A fixing device according to claim 12, wherein said heating means comprises a heater which exhibits a substantially uniform distribution of heat generation over the full rotational direction of said first rotatable member.

15. A fixing device according to claim 12, wherein said heating means whose amount of generated heat is greater in a central portion of said first rotatable member than in both end portions of said first rotatable member with respect to a longitudinal direction.

16. A fixing device for fixing an unfixed image on a recording material, having:

first and second rollers, each having a peripheral surface having an average surface roughness, for holding therebetween and conveying the recording material;

means for urging said first and second rollers against each other to press the recording material between said first and second rollers;

said first roller being an elastic roller and being positioned to contact that side on which said unfixed image on said recording material is to be fixed and contact said unfixed image;

said second roller being an elastic roller and being positioned to contact the side opposite to that side on which said unfixed image on said recording material is to be fixed and to contact said recording material;

the average roughness $R_z$ of said peripheral surface of said first roller being greater than the average roughness $R_z$ of said peripheral surface of said second roller, wherein the average surface roughness $R_z$ of said first roller is $1\mu$ to $20\mu$ and the average surface roughness $R_z$ of said second roller is $6\mu$–$25\mu$.

17. A fixing device according to claim 16, further comprising means for cleaning the surface of said second roller.

* * * * *

UNITED STATES PATENT AND TRADEMARK OFFICE

CERTIFICATE OF CORRECTION

PATENT NO. : 4,580,033

DATED : April 1, 1986

INVENTOR(S) : MASAAKI SAKURAI

It is certified that error appears in the above-identified patent and that said Letters Patent is hereby corrected as shown below:

Column 2, line 22, change "cf" to --of--;
line 65, delete "and".
Column 3, line 8, delete "and".
Column 8, line 5, change "μ" to --8μ--.
Column 9, line 50, delete ",".

Signed and Sealed this

Fourteenth Day of November, 1989

*Attest:*

JEFFREY M. SAMUELS

*Attesting Officer* *Acting Commissioner of Patents and Trademarks*